United States Patent [19]

Burchett

[11] 4,153,232

[45] May 8, 1979

[54] APPARATUS FOR ACTUATING INNER AND OUTER FORMS OF A CONCRETE PIPE FORMING MOLD

[75] Inventor: Keith L. Burchett, Golden Valley, Minn.

[73] Assignee: C.S. Johnson Company, Champaign, Ill.

[21] Appl. No.: 855,390

[22] Filed: Nov. 28, 1977

[51] Int. Cl.[2] ..... B28B 21/88

[52] U.S. Cl. ..... 249/153; 249/169; 249/179; 249/219 R

[58] Field of Search ..... 24/263 B; 285/419, 373, 285/320; 425/451 S; 249/153, 168, 169, 173, 179, 219 R

[56] References Cited

U.S. PATENT DOCUMENTS

| | | | |
|---|---|---|---|
| 771,508 | 10/1904 | Swink | 249/153 |
| 1,278,479 | 9/1918 | Kellar | 249/173 |
| 1,837,092 | 12/1931 | Almquist | 249/173 |
| 2,683,912 | 7/1954 | Serrell | 249/173 |
| 3,164,877 | 1/1965 | Lee | 249/179 |

*Primary Examiner*—Roy Lake
*Assistant Examiner*—John McQuade
*Attorney, Agent, or Firm*—Burns, Doane, Swecker & Mathis

[57] ABSTRACT

A concrete pipe molding apparatus includes inner and outer mold forms defining an annular chamber therebetween. The outer form comprises first and second form sections. These sections are completely separable along two longitudinal gates. A clamp assembly is provided at each gate for releasably securing the outer form sections together. The clamp comprises an eccentric disc mounted for rotation on the first mold section. A locking arm is rotatably mounted on the eccentric disc. The locking arm includes a clamping hook which is releasably engageable with a flange on the second form section. A motor is operably connected to the eccentric disc for rotating the hook away from and toward the flange. The inner form comprises a pair of form portions that are separable along a gate. A mechanism is provided for collapsing the inner form to permit removal thereof from a hardened pipe.

21 Claims, 7 Drawing Figures

56
82
86
70
26
60
58
72
52
54
34
80
48
42
46
21
22
19
36
44
10
14
16
7
12
128
126
129
150
156
110
158
120
134
144
146
102
140
148
112
142
100
136
114
132
122
104
20
22
21
18
19
50
46
2
42
36
48
80
24
54
52
72
58
60
70
86
34
56
82
2

104
114
100
112
102
131
130
128
158
162
160
138
134
150
138
128
136
158
129
12
14
14
6
6
128
138
150
129
146
148
144
128
150
131
130
142
15

APPARATUS FOR ACTUATING INNER AND OUTER FORMS OF A CONCRETE PIPE FORMING MOLD

BACKGROUND AND OBJECTS OF THE INVENTION

The present invention relates to molds for forming concrete pipe and, more particularly, to clamp mechanisms for locking the molds prior to a concrete pouring step and thereafter unlocking the molds to permit removal of hardened pipe.

In the fabrication of concrete pipes, a mold comprising spaced inner and outer mold forms is arranged in upright fashion. Concrete is poured into an annular chamber formed between the forms and allowed to harden. Thereafter, the outer mold form is opened, the inner mold is collapsed, and the hardened pipe is separated therefrom.

One type of outer mold form which is commonly utilized is of two-piece design, including a pair of semicylindrical sections which are secured together during pouring and later completely separated from one another to completely expose the hardened pipe for removal. These outer form sections are joinable together along two longitudinal mating edges, commonly referred to as "gates", which are tightly closed during the pouring step.

Locking connections between the outer form sections have been heretofore utilized in which manually securable clamps are attached between outwardly extending flanges of the form sections. Such clamps may include a series of bolts along each gate which are manually tightened to draw the flanges together into tight sealing relationship. Later, the bolts can be removed to allow the outer form sections to be taken apart. It will be realized that locking connections which require manual insertion, tightening and/or removal can involve considerable time and effort to manipulate.

Clamping systems have been previously proposed for outer mold forms in which a clamp linkage is fastened to both flanges at a gate, and a hand lever is connected to an eccentric shaft of the clamp linkage by means of which the flanges can be drawn tightly together or separated. In this regard, see U.S. Almquist Pat. No. 1,837,092 issued Dec. 15, 1931. However, devices of this type are not well suited to two-gate outer forms since the connection of the clamp linkage to both flanges precludes complete separation of the form sections. Moreover, the hand actuated linkage may become rusted or otherwise fouled and thus extremely difficult to actuate, requiring that it be subjected to the blows of a mallet.

The inner mold form is typically constructed of a cylindrical member which is divided along a longitudinally extending gate to define a pair of inner form portions whose outer edges are movable toward and away from one another. In order to remove the finished pipe, one inner form portion is collapsed within the other. Often this is accomplished by hammering a wedge between the hardened pipe and one form portion to deflect the edge thereof radially inwardly. This practice can involve considerable time and effort.

It is, therefore, an object of the present invention to minimize or obviate problems of the sort discussed above.

It is another object of the invention to provide novel locking mechanisms for inner and outer mold forms which are operable by remote control.

It is a further object of the invention to provide novel locking mechanisms for two-piece mold forms which do not require manual clamping efforts.

It is a further object of the invention to provide a novel locking mechanism for two-piece outer mold forms which is operated by a motor to clamp individual sections of the mold form together or completely release these sections from one another to permit removal of a pipe.

It is still another object of the present invention to provide a novel locking mechanism for an inner mold form which is operated by a motor to flex an edge of one form portion radially inwardly and then into the other form portion to effectively collapse the mold.

It is an additional object of the invention to provide novel mold locking mechanisms which are adapted for retrofit in existing concrete pipe molding units.

SUMMARY OF A PREFERRED EMBODIMENT OF THE INVENTION

In achieving the objects of the present invention a molding apparatus for fabricating concrete pipe includes inner and outer mold forms defining an annular chamber therebetween. The outer form comprises first and second form sections. These sections are completely separable along two longitudinal gates. A clamp assembly is provided at each gate for releasably securing the form sections together and enabling the form sections to be completely separated for the sideward removal of hardened pipe therefrom. An eccentric disc is mounted for rotation on the first mold section. A locking arm is mounted on the eccentric disc for rotation relative thereto. The locking arm includes a clamping hook which is engageable with a flange on the second form section and is completely disengageable therefrom is response to selective rotation of the eccentric disc. A motor is operably connected to the eccentric disc for rotating the latter in one direction to displace the hook away from the flange and in the other direction to bring the clamping portion into engagement with the flange. A guide surface on the first form section engages a portion of the locking arm during displacement of the hook away from the flange. The guide surface is arranged to impart rotation to the locking arm relative to the eccentric disc to intensify the rate of displacement of the clamping portion away from the flange. A spring is arranged to be energized by the locking arm during displacement of the hook away from the flange, to store energy which is released to augment the force of the motor in returning the hook into engagemene with the flange, and to intensify the rate of displacement of the hook toward the flange.

The inner form comprises a pair of form portions that are separable along a gate. A mechanism is provided for collapsing the inner form to permit removal thereof from a hardened pipe. The collapsing mechanism comprises an eccentric disc mounted for rotation on one of the mold portions. A connecting arm is rotatably mounted on the eccentric disc. The connecting arm is connected to the other form portion. A motor is connected to rotate the eccentric discs in a manner causing the connecting arm to flex the other form portion inwardly so as to reduce the diameter of the inner form and thereby permit removal of the form from a hardened pipe.

THE DRAWINGS

These objects will become apparent from the subsequent detailed description of the invention in connection with the accompanying drawings in which like numerals designate like elements and in which:

FIG. 1 is a plan view of a pipe forming mold depicting clamping mechanisms for the outer mold form and a collapsing mechanism for the inner mold form. These clamping and collapsing mechanisms are depicted in out of proportion scale for clarity. An upper bracket of each of the clamping mechanisms has been removed to expose details of the clamping mechanisms. The clamping and collapsing mechanisms are illustrated in positions maintaining the inner and outer forms closed.

DETAILED DESCRIPTION OF A PREFERRED EMBODIMENT OF THE INVENTION

Figure 1:
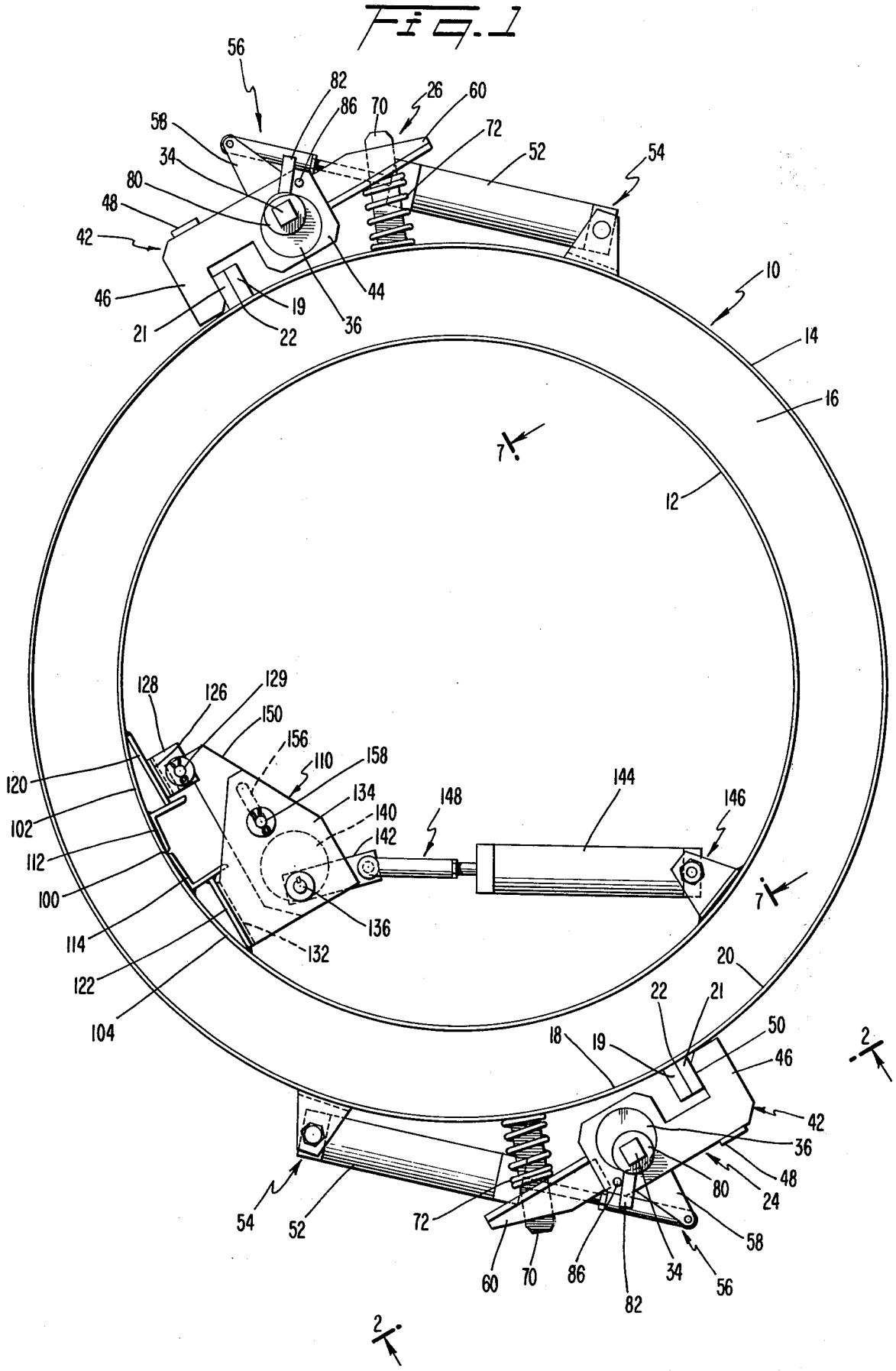

In accordance with the present invention a concrete pipe mold 10 comprises inner and outer annular mold forms 12, 14 which are mounted in conventional fashion upon a base 15. Although depicted as cylindrical, the annular forms can be of other annular configurations such as elliptical or rectangular for example, as will be appreciated by those skilled in the art. These forms are spaced radially from one another to form an annular chamber 16 therebetween. The chamber 16 is arranged in upright fashion and is upwardly open for receiving poured concrete for the fabrication of cylindrical concrete pipes.

Outer Mold Form

The outer mold form includes a pair of semi-cylindrical sections 18, 20 which include longitudinally extending mating edges or gates 22 that can be completely separated from one another. The outer form sections 18, 20 carry radially extending flanges 19, 21 disposed longitudinally therealong.

At each gate there is mounted a locking assembly 24, 26. These locking assemblies 24, 26 are essentially identical and thus only one assembly 24 will be described in detail below.

Figure 2:
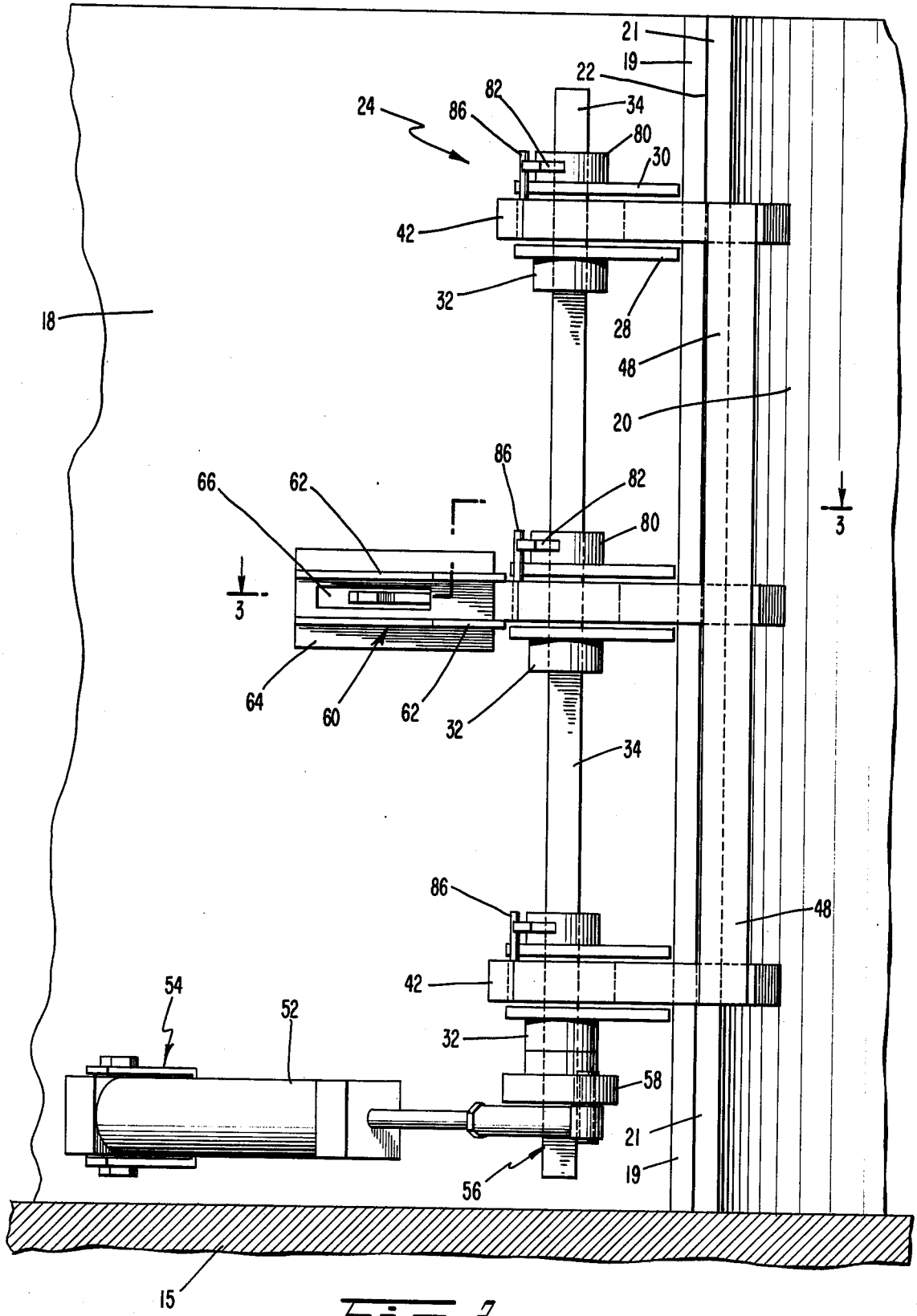
FIG. 2 is a side elevational view of one of the clamping mechanisms of FIG. 1, taken along line 2—2 in FIG. 1.

The locking assembly 24 includes a plurality of pairs of longitudinally or vertically spaced brackets 28, 30 fixedly secured, as by welding for example, to a first form section 18 of the form sections 18, 20 (FIG. 2). One bracket 28 of each pair of brackets 28, 30 carries a rotary bearing 32, with the bearings 32 being aligned vertically to receive a rectangular shaft 34.

Figure 3:
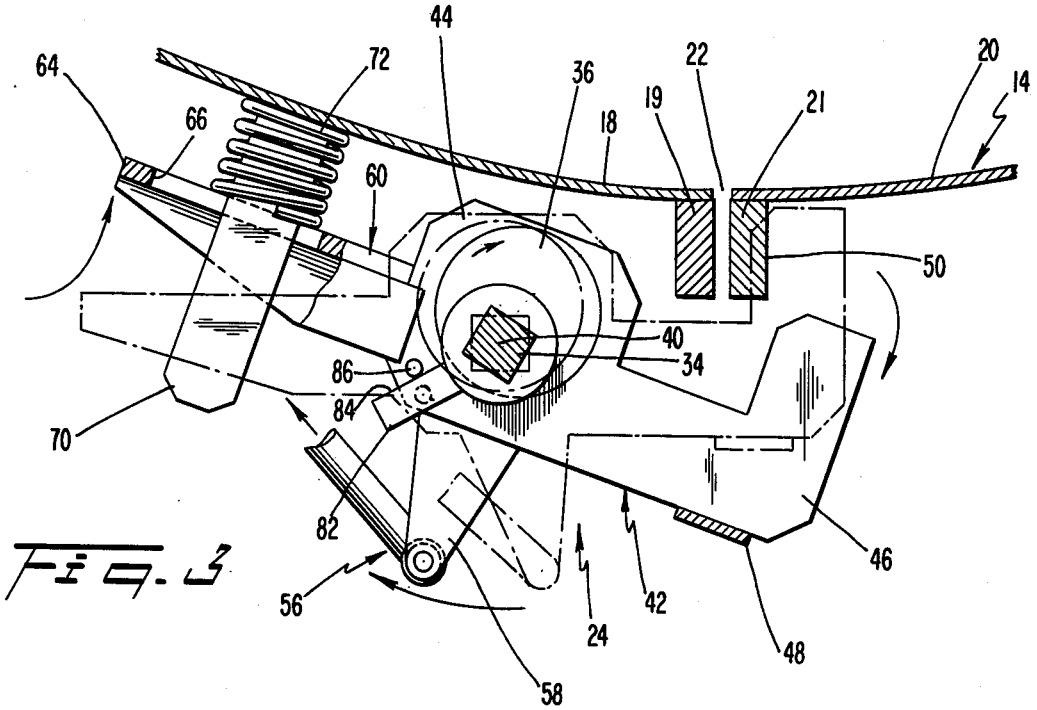
FIG. 3 is a sectional view of the clamping mechanism, taken along line 3—3 in FIG. 2. The broken lines depict the clamp in the form closing position shown in FIGS. 1 and 2, and the solid lines depict the clamp in a form unlocking position.

Keyed on the shaft 34 for rotation therewith at locations longitudinally intermediate the brackets 28, 30 are eccentric discs 36 (FIGS. 1 and 3). Each eccentric disc 36 is circular and includes a shaft-receiving opening whose center is offset from the center 40 of the shaft 34 (FIG. 3).

Mounted on each of the eccentric discs 36 is a horizontally situated locking arm 42. Each locking arm includes a base portion 44 which contains a circular aperture for receiving the eccentric disc 36. The locking arm 42 is rotatable about the eccentric disc 36, and a grease fitting (not shown) may be mounted on the locking arm 42 for the introduction of lubricating grease into the aperture to facilitate such relative rotation.

Integral with and extending outwardly from the base portion 44 toward the other outer form section 20 is a clamping hook portion 46 which is operable to engage, from behind, the flange 21 of the other form section 20. All of the hooks 46 of the arms 42 are preferably interconnected for common movement by a longitudinal bar 48 which is affixed to each hook 46.

As indicated in FIGS. 1 and 3, the hook 46 is engageable with a rear surface 50 of the flange 21 to close the gate 22. It will be appreciated that the eccentric disc 36 can be rotated relative to the locking arm 42 (in a clockwise direction as viewed in FIG. 3) to cause the clamping hook 46 to travel away from the flange 21, as depicted by solid lines in FIG. 3. Since the center 38 of the eccentric disc 36 is situated between the mold form 14 and the center 40 of the shaft 34, the direction of travel of the hook 46 includes a component which is generally radial (in relation to the outer form 14), and another component which is generally laterally of, preferably aboout perpendicular to, the radial direction. As a result, the hook 46 moves from behind the flange 21 without appreciable frictional scraping contact with the surface 50 of the flange 21.

Rotation of the shaft 34 is effected by a remotely-controlled motor, preferably in the form of a fluid-actuated piston-cylinder ram assembly 52. This ram 52 is pivotably mounted by a vertical pivot at one of its ends 54 to the first form section 18 and by a vertical pivot at the other of its ends 56 to a lever 58 affixed for rotation to the shaft 34. Extension of the ram 52 rotates the shaft 34 in a clamping direction (counterclockwise as viewed in FIG. 3), and retraction of the ram 52 rotates the shaft 34 in an unclamping direction (clockwise as viewed in FIG. 3).

Mounted on the base portion 44 of one of the locking arms 42 and extending outwardly therefrom in a direction opposite the hook 46, is an extension leg portion 60. This leg 60 comprises a pair of parallel flanges 62 which are fixedly connected, as by welding for example, to the base portion 44. A plate 64 is fixedly secured to the flanges 62 and includes a slot 66.

This slot 66 is dimensioned to receive, with considerable play, a post 70 which is fixedly secured to the first outer form section 18. The post 70 extends generally radially outwardly from the first form section 18 and carries a coil compression spring 72. This spring 72 is arranged to react between the first form section 18 and the leg 60 of the locking arm to urge this leg 60 away from the form section 18.

Secured to the shaft 34 for rotation therewith are a plurality of sleeves 80 (FIG. 2), the sleeves being disposed adjacent respective ones of the locking arms 42.

Mounted fixedly to each sleeve is a horizontal finger 82 which includes a contact face 84 extending generally perpendicularly relative to the axis of the shaft 34.

Fixedly connected to the base 44 of the locking arm 42 and extending upwardly therefrom is a pin 86. This pin is situated between the contact face 84 of the finger 82 and the form section 18 whereby the finger 82 is operable to contact and displace the pin 86 when the shaft 34 is rotated in an unlocking direction. As a result, the finger 82 drives the locking arm 42 about the eccentric disc 36 in a direction (clockwise as viewed in FIG. 3) in which the hook 46 travels away from the flange 21 and in which the extension leg 60 compresses the spring 72. Importantly, the hook travels in a direction having a radial component and a component generally perpendicular relative to radial, and thus travels laterally of the radius in a direction forming an acute angle relative to the radius. In this fashion, the hook is quickly displaced from the flange without appreciable frictional contact therewith, and the leg 60 energizes the spring 72. It is anticipated that a 75 to 90 degree rotation of the shaft will be sufficient to completely shift the hook 46 from behind the flange 21.

It will be realized that in lieu of the rotating finger 82, other types of locking arm-engaging structure can be provided for achieving this result. For example, a stationary finger could be provided which presents a guide surface oriented so that as the eccentric disc is rotated, the pin 86 is constrained to follow the guide surface in a manner causing the locking arm to rotate about the eccentric disc, although perhaps not at the same intensified rate as that caused by the rotating finger 82 in the preferred embodiment described previously.

With the locking arms 42 of both clamps 24, 26 in an unlocking condition (solid lines of FIG. 3), the outer mold form sections 18, 20 can be completely separated from one another and removed from around a hardened pipe.

When the locking arms 42 are shifted to a locking position to initiate a subsequent concrete pouring procedure, as by extending the rams 52, the springs 72 exert a force on the locking arms 42 tending to aid the rams 52 in rotating the locking arms to their locking positions.

Inner Mold Form

The inner mold form 12 comprises a cylindrical shell member which is divided along a vertical parting line or gate 100 so as to divide the inner mold form into form portions 102, 104. The outer edges 106, 108 of these form portions 102, 104 are inclined relative to a radial direction, to facilitate collapsing of the inner mold, as will become more apparent.

At the gate 100 there is mounted an inner form actuating assembly 110. This actuating assembly 110 comprises a pair of upright angle iron flanges 112, 114 which are welded to respective inner surfaces of the respective inner form sections 102, 104 on opposite sides of the gate 100. Secured to generally radially extending leg portions 116, 118 of the flange members 112, 114 are first and second mounting plates 120, 122 which extending uprightly along the inner form sections. Fixedly secured to the first mounting plate 120 is a first bracket assembly 124 which includes an upright plate portion 126 and a plurality of pairs of parallel, vertically spaced first brackets 128. The pairs of first brackets 128 are spaced vertically along the inner form section 102 and include openings which are vertically aligned and which receive a vertical rod 129. The rod 129 is held in place by washers 130 and cotter pins 131.

Attached to the second mounting plate 122 is a second bracket assembly 130 which includes an upright plate portion 132 and a plurality of pairs of parallel, spaced-apart stationary second brackets 134. The second brackets 134 are spaced vertically along the inner form section and include vertically aligned apertures which receive a shaft 136 projecting therethrough. The shaft 136 is rotatably carried by collars 138 which are affixed to opposite sides of the second brackets 134.

Keyed onto the shaft 136 for rotation therewith are a plurality of eccentric discs 140. Each eccentric disc 140 is disposed between a pair of the second brackets 134.

Connected fixedly to the shaft 136 is a lever 142 (FIG. 4) which, when rotated, rotates the shaft 136 and the eccentric discs 140. A hydraulically powered ram 144 includes a cylinder end 146 pivotably connected to the inner form section 104, and a rod end 148 which is pivotably connected to the lever 142. It will be realized that extension of the ram 144 imparts rotation to the shaft and eccentric discs (counterclockwise as viewed in FIG. 4).

Mounted on each of the eccentric discs 140 is a connector arm 150. The connector arm 150 includes at one end 151 a bore which receives the eccentric disc 140.

At its other end 153 the connector arm 150 is disposed between a pair of the first brackets 128. The end 153 of the connector arm 150 includes a first slot 154 which receives the rod 129. This slot 154 is oriented generally perpendicular to the radius of the inner mold form 12 when the clamp is closed (FIG. 6).

Each connector arm 150 also includes a second elongated slot 156 located intermediate the arm ends. The second slot 156 is oriented generally parallel relative to the first slot 154. Extending vertically through the second brackets 134 and through the connector arms 150 is a bar 158. This bar 158 is held in place by a washer 160 and cotter pin 162 at each end.

Figure 6:
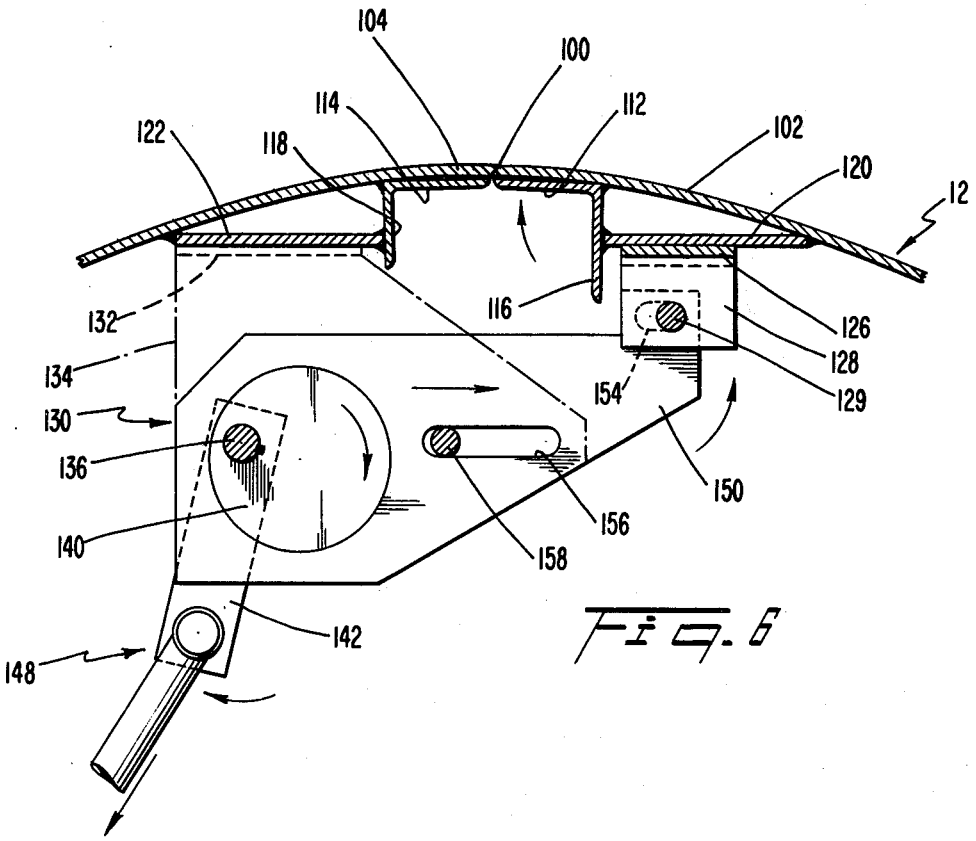
FIG. 6 is a view similar to FIG. 4 and taken along line 6—6 of FIG. 7, depicting the collapsing mechanism in a position maintaining the inner form closed.
Figure 7:
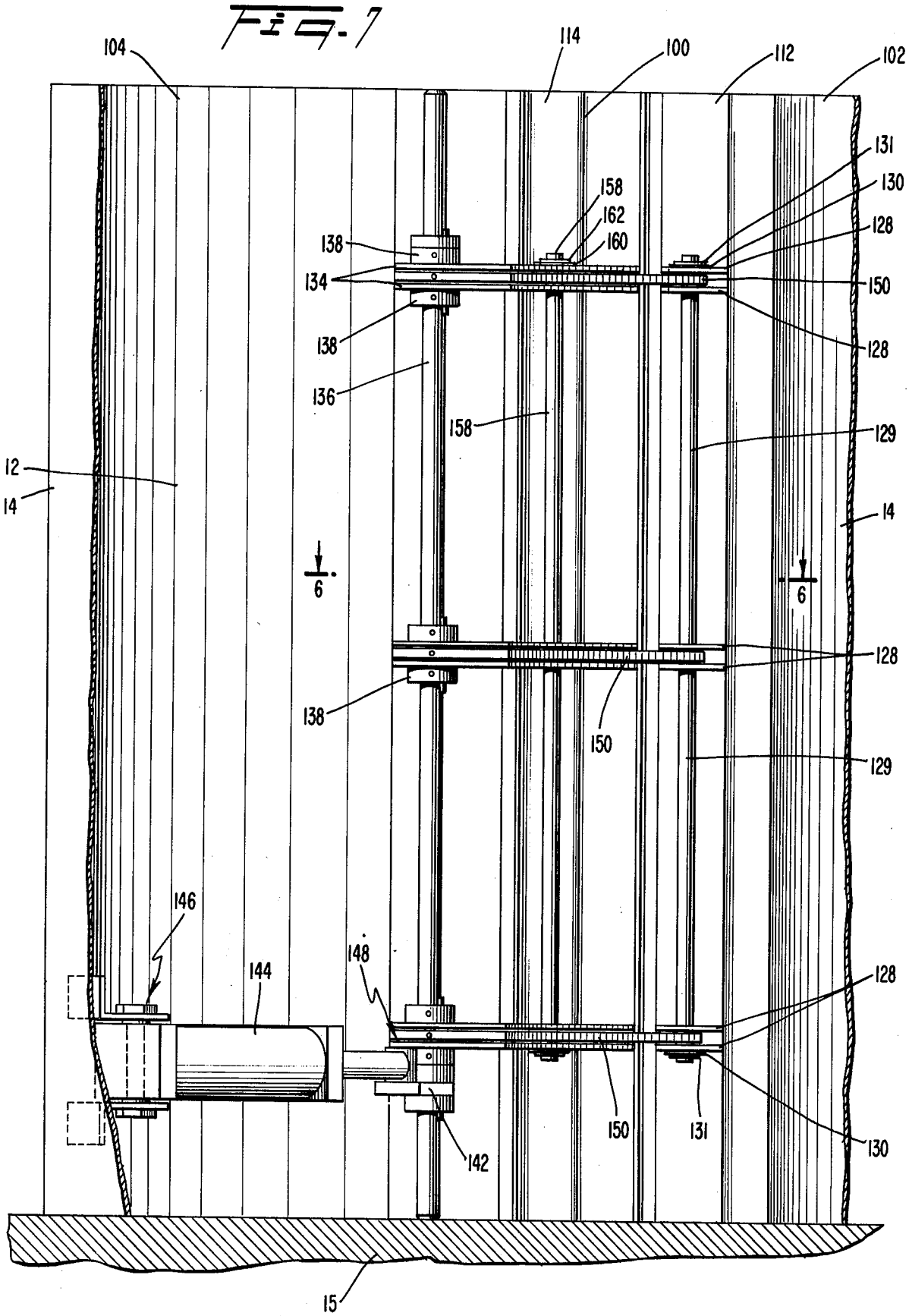
FIG. 7 is a side elevational view of the collapsing mechanism, taken along line 7—7 of FIG. 1.

In FIGS. 1 and 6 the inner form portions 102, 104 are depicted in a closed condition ready for receiving pouring concrete, the ram 144 is extended so as to rotate the shaft 136 and eccentric discs 140 in a direction (counterclockwise in FIG. 3) which causes the form portions 102, 104 to be collapsed inwardly.

Figure 4:
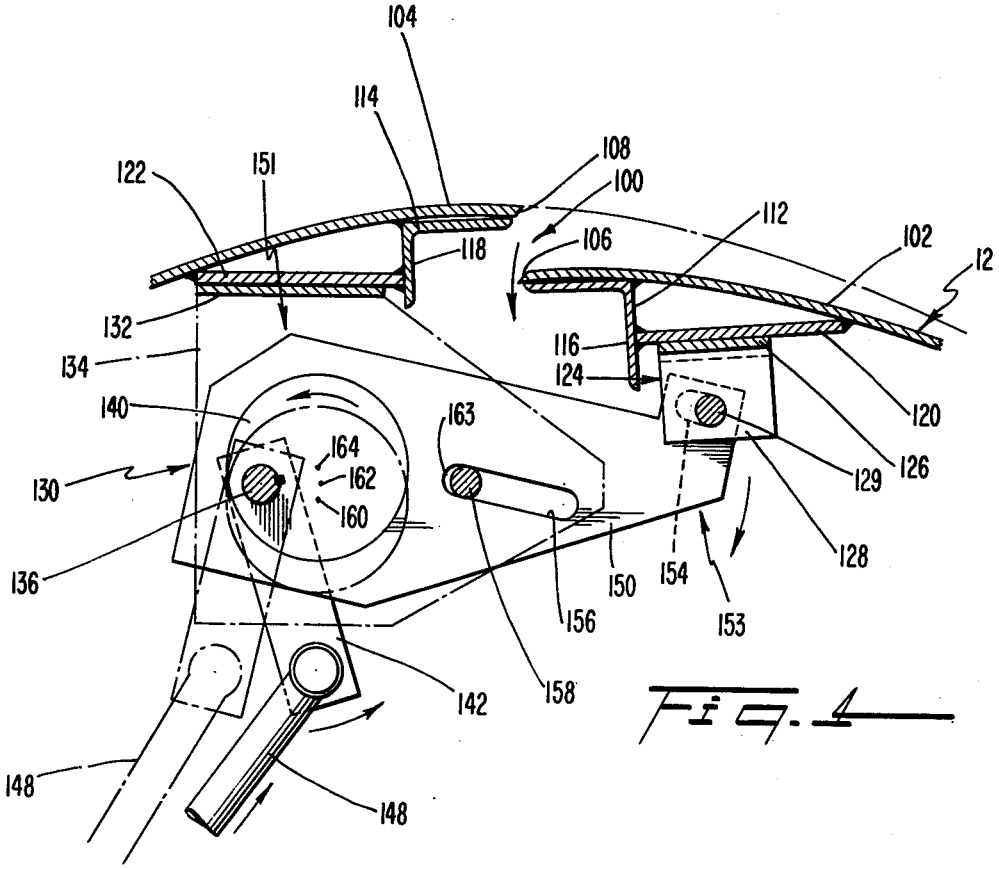
FIG. 4 is a sectional view of the inner form collapsing mechanism. The broken lines depict the collapsing mechanism in a position closing the inner form, and the solid lines depict the clamp in a position partly collapsing the inner mold.

More specifically, the center of each eccentric disc 140 rotates about the center of the shaft 136. During an initial portion of this rotation, the center of the eccentric disc travels from point 160 to point 162 (FIG. 4). Accordingly, the end 151 of the connector arm 150 travels in a direction having a generally radial component toward the inner form portion (preferably perpendicular to radial) and toward the form portion 102. The radial component of travel results in the connector arm 150 being rotated about the bar 158 as a fulcrum, in a direction (clockwise as viewed in FIG. 4) causing the brackets 128 to be displaced generally radially inwardly (to the right as viewed in FIG. 4) by the end 153 of the connector arm 150. Displacement of the brackets 128 radially inwardly produces a corresponding flexing of the free end of the form portion 102 radially inwardly to separate the edges 106, 108 of the form sections 102, 104.

It should be pointed out that during this interval, the translatory component of travel laterally of radial is taken-up or absorbed by a lost-motion connection comprising the slots 154 and 156 of the connector arm. In this regard, the end of the slot 156 adjacent the eccentric disc 140 provides a slight clearance 163 relative to the bar 158 allowing for a slight amount of free movement of the connector arm 150.

Further rotation of the center of the eccentric disc to the point 164 (FIG. 4) produces further inward flexing of the form portion 102. Movement of the connector arm 150 in a direction perpendicular to radial during this interval merely shifts the slots 154, 156 back to the same positions relative to the rod 129 and the bar 158 as when the disc center was located at point 160.

Figure 5:
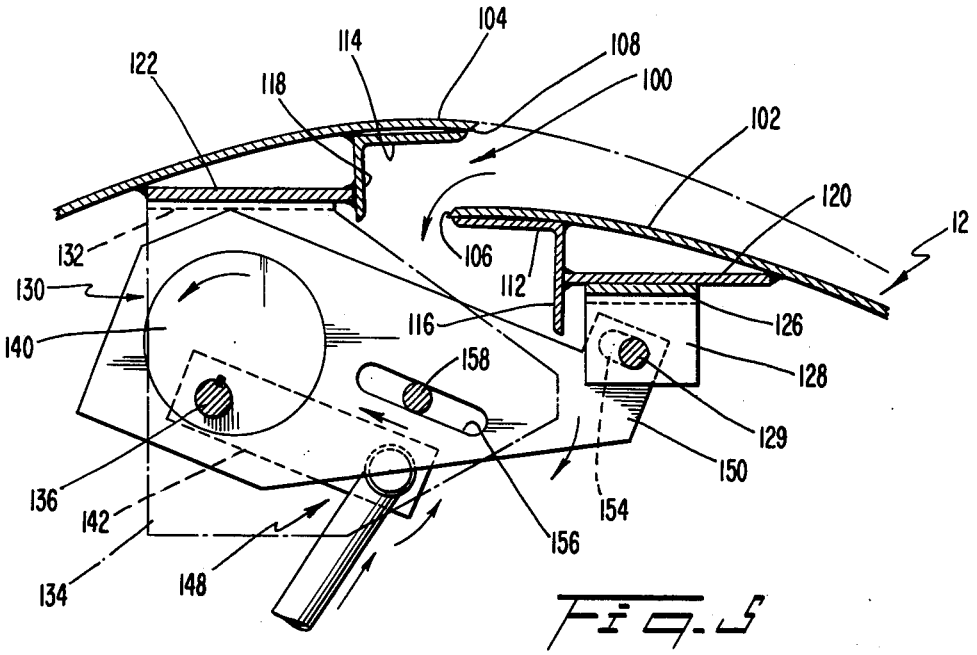
FIG. 5 is a view similar to FIG. 4 depicting the collapsing mechanism in a position fully collapsing the inner mold.

Further rotation of the disc center beyond the point 164 produces continued motion of the end 153 of the connector arm 150 in a direction having components which are generally radial and generally laterally of radial, i.e., in a direction forming an acute angle relative to the radial direction. Since an end of the first slot 154 engages the rod 129 during this interval, the brackets 128 will be displaced not only radially but also generally laterally of radial as shown in FIG. 5. Thus, the edge 106 will be shifted laterally of radial and relative to the edge 108, so that the inner diameter of the inner form is reduced. Movement of the connector arm 150 in this direction is accommodated by the slot 156 which travels relative to the bar 158. In the collapsed position, the inner form 12 can be lifted from the center of the pipe.

To return the inner form 12 to a closed position for a subsequent pipe forming operation, the ram 144 is retracted and the connector arm 150 travels reversely along the same path described above, to reengage the free ends 106, 108 of the inner form portions 102, 104.

OPERATION

Prior to the pouring of concrete into the annular chamber 16, the outer mold form sections 18, 20 are brought together and secured in place by the clamps 24, 26, and the inner sections 102, 104 are locked together by the form actuating assembly 110.

After a batch of concrete has been poured into the annular chamber 16 and hardens, the outer form sections 18, 20 are unlocked by retraction of the rams 52. Such retraction serves to rotate the eccentric discs 36 in an unclamping direction (clockwise as viewed in FIG. 3). As a result, the hooks 46 are shifted away from the flange 21 in a direction which forms an acute angle relative to the radial direction. Contact between the rotating fingers 82 and the pins 86 imparts rotation to the locking arms 42 such that the hooks 46 are quickly displaced completely from behind the flange 21 without frictional contact therewith, and the extension leg 60 compresses the spring 72.

With the hooks 46 of both locking assemblies 24, 26 having been displaced from behind the flanges 21, the outer form sections are able to be completely removed from around the pipe.

To remove the inner form 12 from the pipe, the ram 144 is extended, to rotate the eccentric discs 140 about the center of the shaft 136. Accordingly, the connector arms 150 rotate about the bar 158 (clockwise as viewed in FIG. 4) to flex the inner form portion 102 initially in a radially inward direction to mutually separate the edges 106, 108 of the form portions, and then in a direction having components which are radial and laterally of radial so that the inner mold form 12 becomes collapsed. Accordingly, the inner form 12 can be lifted from the pipe.

To prepare the mold for a subsequent pipe fabricating operation, the ram 52 of the outer mold form 14 is extended to rotate the eccentric discs 36 and the hooks 46 (counterclockwise in FIG. 1) and so that the hooks engage the rear surface 50 of the flange 21. The spring 72 aids in rotating the hooks 46 to assure that a firm engagement is achieved between the hooks 46 and the flange 21.

The inner form 12 is closed by retracting the ram 144 and thus rotating the eccentric discs 140 (clockwise in FIG. 4). This serves to rotate the connector arm 150 (counterclockwise in FIG. 4) about the bar 163 as a fulcrum. Accordingly, the edge 106 of the inner mold portion 102 assumes a closed position against the edge 108 of the other inner form portion 104 (FIG. 6).

SUMMARY OF MAJOR ADVANTAGES AND SCOPE OF THE INVENTION

By virtue of the present invention the inner and outer forms of a pipe forming mold can be locked and unlocked by remotely controlled power means. This eliminates the need for manual actuation of hand-lever operated valves.

The clamp mechanisms for the inner and outer forms may be easily installed onto existing molds without requiring extensive modification of the molds.

The hooks for the outer mold form travels in a direction which assures that virtually no frictional wearing thereof occurs. The spring assist during clamp closing assures that tight engagement between the hooks and flange will be achieved and maintained.

The inner mold form is collapsed by initially flexing one of the form portions in a radial direction to assure that the edge thereof clears the edge of the other form portion, and thereafter in a direction which collapses the inner form.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a molding apparatus for fabricating concrete pipe of the type including an inner mold form and an outer mold form which comprises a pair of form sections that are completely separable along two gates, and clamping means at each gate for releasably securing said form sections together and enabling said form sections to be completely separated for the removal of hardened pipe, the improvement wherein each clamping means comprises:

an eccentric disc mounted for rotation on one of said form sections;

a flange on the other form section;

a locking arm mounted on said eccentric disc for rotation relative thereto;

said locking arm including a clamping portion which is engageable with said flange on said other form section and is completely disengageable therefrom in response to selective rotation of said eccentric disc;

motor means operably connected to said eccentric disc for rotating the latter in one direction to displace said clamping portion away from said flange, and in the other direction to bring said clamping portion into engagement with said flange, and contact surface means rotatable with said eccentric disc, said contact surface means being engageable with a portion of said locking arm during displacement of said clamping portion away from said flange to impart rotation to said locking arm relative to said eccentric disc in a manner displacing said clamping portion away from said flange.

2. A molding apparatus according to claim 1, further including a spring arranged to be energized by said locking arm during displacement of said clamping portion away from said flange to store energy which is released during the return of said clamping portion toward engagement with said flange to augment the force of said motor means.

3. A molding apparatus according to claim 1, further including a shaft mounted for rotation on said one form section, there being a plurality of said eccentric discs mounted on said shaft for rotation therewith; there being a plurality of said locking arms mounted on respective ones of said eccentric discs; a plurality of fingers mounted for rotation on said shaft, each finger including said contact surface means for engaging an associated locking arm.

4. A molding apparatus according to claim 3, wherein said motor means comprises a fluid actuated piston-cylinder assembly connected between said one form section and said shaft.

5. A molding apparatus according to claim 2, wherein said spring comprises a coil compression spring mounted between said one form section and an extension leg portion of said locking arm.

6. A molding apparatus according to claim 1, wherein said clamping portion comprises a hook-shaped end of said locking arm.

7. In a molding apparatus for fabricating concrete pipe of the type including an inner mold form and an outer mold form which comprises a pair of form sections that are completely separable along two longitudinal gates, and clamping means at each gate for releasably securing said form sections together and enabling said form sections to be completely separated at both gates for the removal of hardened pipe, the improvement wherein said clamping means comprises:

a shaft rotatably mounted on one of said form sections adjacent a respective gate;

a radial flange on the other form section;

a plurality of eccentric discs mounted in spaced relation along said shaft for rotation with said shaft;

a locking arm mounted on each eccentric disc, each locking arm including a hook-shaped end engageable with said radial flange on the other form section and completely disengageable therefrom in response to selective rotation of said eccentric discs;

motor means mounted on said one form section and connected to said shaft for selectively rotating said eccentric discs in an unlocking direction of rotation to displace said hook-shaped ends away from said flange, and in a locking direction of rotation to displace said hook-shaped ends toward said flange; and contact face means associated with said one form section engageable with said locking arms to cause said locking arms to rotate relative to said eccentric discs in a manner displacing said hook-shaped ends away from said flange.

8. Apparatus according to claim 7, further including spring means energizeable by said locking arm during displacement of said hook-shaped ends away from said flange, to store energy which is released when said hook-shaped ends are displaced toward said flange.

9. Apparatus according to claim 7, wherein said contact face means comprises a finger mounted for rotation with said shaft.

10. A clamp assembly for closing a gate between mold sections, comprising:

an eccentric disc mountable for rotation on one of said mold sections;

a flange mountable on another mold section;

a locking arm mounted on said eccentric disc for rotation relative thereto;

said locking arm including a clamping hook which is engageable with said flange on said other form section and completely disengageable therefrom, in response to eccentric rotation of said eccentric disc;

motor means operably connected to said eccentric disc for rotating the latter in one direction to displace said clamping hook away from said flange, and in another direction to bring said clamping hook towards and against said flange; and a finger mounted for rotary movement with said eccentric disc during displacement of said hook away from said flange, to engage and impart rotation to said locking arm relative to said eccentric disc so as to displace said hook away from said flange.

11. A clamp assembly according to claim 10, including spring means arranged to be energized by said locking arm during displacement of said clamping hook away from said flange, to augment the force of said motor means in returning said clamping hook into engagement with said flange.

12. In a molding apparatus for fabricating concrete pipe of the type including an outer mold form and an inner mold form which comprises a pair of form portions that are separable along a gate, and means for collapsing said inner form to permit removal thereof from a hardened pipe; the improvement wherein said collapsing means comprises:

eccentric disc means mounted for rotation on one of said form portions, connecting arm means mounted at a first end thereof on said eccentric disc means for rotation relative thereto, means connecting said connecting arm means at a second end thereof to the other of said inner form portions;

stationary means;

means mounting said connecting arm means to said stationary means at a point intermediate said first and second ends of said connecting arm means for relative pivotal movement and also relative translating movement in a direction generally laterally of the radial direction;

motor means operably connected to said eccentric disc means for rotating the latter in one direction to displace said connecting arm means in a manner causing it to flex said other form portion inwardly relative to said one form portion so as to reduce the diameter of said inner form and thereby permit removal of said inner form from a hardened pipe.

13. A molding apparatus according to claim 12, said stationary means comprises a bracket fixed to said one form portion, rotation of said eccentric disc means in said one direction being operable to rotate said connecting arm means in a direction for swinging said other form portion generally radially inwardly.

14. A molding apparatus according to claim 12, wherein said eccentric disc means is arranged to displace said connecting arm means in a manner causing it to flex said other form portion in a direction having a component oriented laterally of a radial direction and toward said one form portion.

15. A molding apparatus according to claim 13, wherein said means mounting said connecting arm means pivotably to said bracket includes a pin received in an elongated slot in said connecting arm means, to permit movement of said connecting arm means relative to said bracket; said slot being oriented generally laterally of the radial direction.

16. A molding apparatus according to claim 15, wherein said connecting means comprises another bracket affixed to said other form portion, and a fastener connecting said second end of said connecting arm means to said other bracket; said fastener extending through an elongated slot in said connecting arm means; said last-named elongated slot extending generally parallel to said first-named elongated slot, said eccentric disc means being arranged such that during an initial portion of the rotation thereof in said one direction said connecting arm means moves relative to said brackets in a direction generally laterally of the radial direction so that essentially only radially inwardly directed forces are applied to said other form portion.

17. A molding apparatus according to claim 16, wherein said eccentric disc means is arranged such that during a subsequent portion of said rotation, following said initial portion, said other form portion is flexed in a direction having a component oriented laterally of a radial direction and toward said one form portion.

18. A molding apparatus according to claim 17, wherein said form portions include edges which are angled relative to the radial direction, enabling said other form portion to be flexed inwardly relative to said one form portion.

19. In a molding apparatus for fabricating concrete pipe of the type including an outer annular mold form and an annular inner mold form which comprises a pair of form portions that are separable along a gate, and means for collapsing said inner form to permit removal thereof from a hardened pipe, the improvement comprising:

a shaft mounted for rotation on one of said form portions;

a plurality of discs mounted eccentrically on said shaft for rotation therewith;

a connecting arm mounted at a first end thereof on each of said eccentric discs for rotation relative thereto;

means connecting each connecting arm at a second end thereof to the other form portion;

a stationary means;

means mounting said connecting arms to said stationary means at a point intermediate said first and second ends of each arm for relative pivotal movement and also relative translatory movement in a direction generally laterally of the radial direction;

motor means operably connected to said shaft for rotating said eccentric discs in one direction to flex said other form portion inwardly in a manner reducing the diameter of said inner form to permit removal of said inner form from a hardened pipe, and in the opposite direction to reengage said form portions to close said gate;

said connecting means including means constraining said other form portion to move in a generally radial direction during a first portion of eccentric disc rotation in said one direction and thereafter permitting movement of the end of said other form portion toward said one form portion in a direction generally laterally of the radial direction.

20. A molding apparatus for forming concrete pipe comprising:

inner and outer annular forms spaced radially from one another to define an annular chamber therebetween for receiving concrete;

said inner form comprising a pair of form portions which are separable along at least one gate; and means for collapsing said inner form to permit removal thereof from a hardened pipe comprising:

a plurality of vertically aligned first brackets mounted on one of said form portions;

a plurality of vertically aligned second brackets mounted on the other of said form portions;

a shaft mounted on said second brackets for rotation;

a plurality of discs mounted eccentrically along said shaft for rotation therewith;

a plurality of connecting arms mounted at a first end on respective ones of said eccentric discs for rotation relative thereto, and mounted at a second end to respective ones of said first brackets;

each connecting arm being mounted intermediate its ends to its associated second bracket for rotation about a vertical axis and for relative sliding movement in a direction generally laterally of the radial direction;

said second end of said connecting arm being movable relative to its associated first bracket in a direction generally laterally of the radial direction; and a motor means connected to said shaft for rotating said eccentric discs:

in one direction to swing said connecting arms about said vertical axis such that said second ends thereof pull an end of said one form portion radially inwardly as said second ends move relative to said first brackets a predetermined distance, and thereafter pull said end of said one form portion toward said other form portion in a direction generally laterally of the radial direction, and in the opposite direction to return said form portions into engaging relationship to close said gate.

21. Molding apparatus according to claim 20, wherein said outer form comprises a pair of form sections which are completely separable along two gates, and clamping means provided at each gate for releasably securing said form sections together, said clamping means comprising:

a second shaft rotatably mounted on one of said form sections adjacent a respective outer form gate;

a radial flange on the other form section;

a plurality of second eccentric discs mounted in spaced relation along said second shaft for rotation with said second shaft;

a locking arm mounted on each second eccentric disc, each locking arm including a hook-shaped end engageable with said radial flange on the other outer form section and completely disengageable therefrom in response to selective rotation of said second eccentric discs;

second motor means mounted on said one form section and connected to said second shaft for selectively rotating said second eccentric discs in an unlocking direction of rotation to displace said hook-shaped ends away from said flange, and in a locking direction of rotation to displace said hook-shaped ends towards said flange; and contact face means on said one form section engageable with said locking arms to cause said locking arms to rotate relative to said second eccentric discs in a manner displacing said hook-shaped ends away from said flange.

* * * * *